United States Patent [19]

Saegusa et al.

[11] 4,301,716

[45] Nov. 24, 1981

[54] REFRIGERANT COMPRESSOR UNITS

[75] Inventors: Nobuaki Saegusa; Kiyoshi Terauchi, both of Isesaki, Japan

[73] Assignee: Sankyo Electric Company Limited, Isesaki, Japan

[21] Appl. No.: 50,542

[22] Filed: Jun. 21, 1979

[30] Foreign Application Priority Data

Jul. 1, 1978 [JP] Japan ..... 53-89949[U]

[51] Int. Cl.[3] ..... F04B 1/18; F01B 3/02

[52] U.S. Cl. ..... 92/71; 417/269; 74/60

[58] Field of Search ..... 417/269, 488, 489; 91/506, 507; 92/71; 74/60

[56] References Cited

U.S. PATENT DOCUMENTS

| | | | |
|---|---|---|---|
| 3,712,759 | 1/1973 | Olson | 417/269 |
| 3,726,189 | 4/1973 | Rubery | 91/506 |
| 3,866,518 | 2/1975 | Miyao | 91/488 |
| 4,042,309 | 8/1977 | Hiraga | 417/269 |

*Primary Examiner*—William L. Freeh

*Attorney, Agent, or Firm*—Hopgood, Calimafde, Kalil, Blaustein & Judlowe

[57] ABSTRACT

In a refrigerant compressor unit of a type in which the reciprocating movement of pistons is caused by the nutation of a non-rotatably but nutatably supported wobble plate driven by a cam rotor. The wobble plate includes a ring member and a bevel gear member. The bevel gear member is provided with a plurality of axial grooves in the peripheral side surface thereof. The gear member is fitted into a counterbore formed in the ring member and secured by caulking the peripheral edge of the counterbore to the ring member. The material of the ring member is moved into the grooves and valleys between the teeth of the gear by the caulking operation so that relative rotation and axial movement of the ring member and gear member is prevented. The wobble plate is supported on a ball bearing so as to be able to nutate about the ball center but is prevented from rotation by engagement of the bevel gear with another bevel gear fixedly supported on the cylinder block.

2 Claims, 8 Drawing Figures

REFRIGERANT COMPRESSOR UNITS

BACKGROUND OF THE INVENTION

This invention relates to refrigerant compressor units of a type in which the reciprocating movement of pistons within cylinders is caused by the nutation of a non-rotatably but nutatably supported wobble plate driven by a cam rotor, and, in particular, to improvements of the wobble plate itself.

Such refrigerant compressor units have been known and advantageously used for compressors in air-conditioning systems for automobiles, because of the their compactness and lightness.

In the refrigerant compressor unit, because the wobble plate is connected to respective pistons by piston rods, the rotation of the wobble plate must be prevented to assure smooth nutation. To this end, the wobble plate has a bevel gear which engages with a mating bevel gear non-rotatably supported on the cylinder block. The wobble plate is supported on the inclined surface of the cam rotor through a needle thrust bearing and is born on a ball bearing seated in ball seats formed in the bevel gears. Thus, the wobble plate nutates about the center of the ball bearing upon the rotation of the cam rotor, and is prevented from rotating by the engagement between the bevel gears.

In a known construction of the wobble plate, the wobble plate 1 comprises a plate member 2 and a bevel gear member 3, as shown in FIGS. 2*a*–2*c*. Bevel gear member 3 is provided with an annular flange 4 on the peripheral side surface and with an axial rectangular boss 5 on the backside. Plate member 2 is provided with a depression 6 for receiving bevel gear member 3. In the bottom of the depression, a rectangular hole 7 is formed for receiving rectangular boss 5. The wobble plate is completed by fitting bevel gear member 3 into depression 6 of plate member 2 with boss 5 being inserted into the hole 7, followed by caulking the radial edge of the depression 6 over annular flange 4, as shown by reference numeral 8. Thus, bevel gear member 3 is secured to plate member 2 to prevent relative axial movement, while relative rotation of the plate member and the bevel gear member is prevented by fitting the boss into the hole.

Plate member 2 is also provided with a plurality of equiangularly spaced ball sockets 9 for receiving end balls of piston rods.

In the known construction, production of the wobble plate is difficult, because the wobbling center is off from the center axis of the wobble plate if hole 7 is not accurately formed at the center of plate member 1.

Furthermore, since relative rotation is prevented near the center of the wobble plate, great strength in preventing relative rotation is not achieved. If the thickness and the length of boss 5 are increased with the thickness of the bottom plate also being increased, strength is increased by on increase in weight of the wobble plate results.

SUMMARY OF THE INVENTION

An object of this invention is to provide a refrigerant compressor unit of the wobble plate type which is simple in structure and production.

Another object of this invention is to provide a refrigerant compressor unit of the wobble plate type which is small in volume, economical in cost, long life, light in weight, and excellent in operation.

A particular object of this invention is to provide an improved wobble plate, to thereby to realize the above objects.

According to this invention, a refrigerant compressor unit is provided which comprises a cylinder block having a plurality of equiangularly spaced cylinders, a plurality of pistons slidably and closely fitted into their respective cylinders, a drive shaft, and a cam rotor mounted on an end of the drive shaft having an inclined end surface. A wobble plate is disposed in proximity with the inclined surface and has a centered first bevel gear which is provided with a centered ball seat. A second bevel gear is supported on the cylinder block and has a centered ball seat. A ball bearing is seated in the ball seats and supports the wobble plate so it may be nutate about the center of the ball. Piston rods connect respective pistons to the wobble plate. The invention is characterized in that the wobble plate comprises a ring member having a counterbore and a first bevel gear member, the first bevel gear member being fitted into the counterbore and secured to the ring member by caulking the peripheral edge of the counterbore to prevent relative rotation and axial movement of the ring member and the bevel gear member.

The bevel gear member may be provided with a plurality of axial grooves in the peripheral side surface thereof, the grooves are formed to be connected with adjacent valleys between adajcent teeth of the bevel gear: The material of the ring member is moved into the grooves and also moved between the teeth by a caulking operation so that relative axial movement and rotation between the plate member and the bevel gear member is prevented.

Further objects, features and aspects of this invention will be understood from the following description of preferred embodiments of this invention and by referring to the annexed darwings.

DETAILED DESCRIPTION OF PREFERRED EMBODIMENTS

Figure 1:
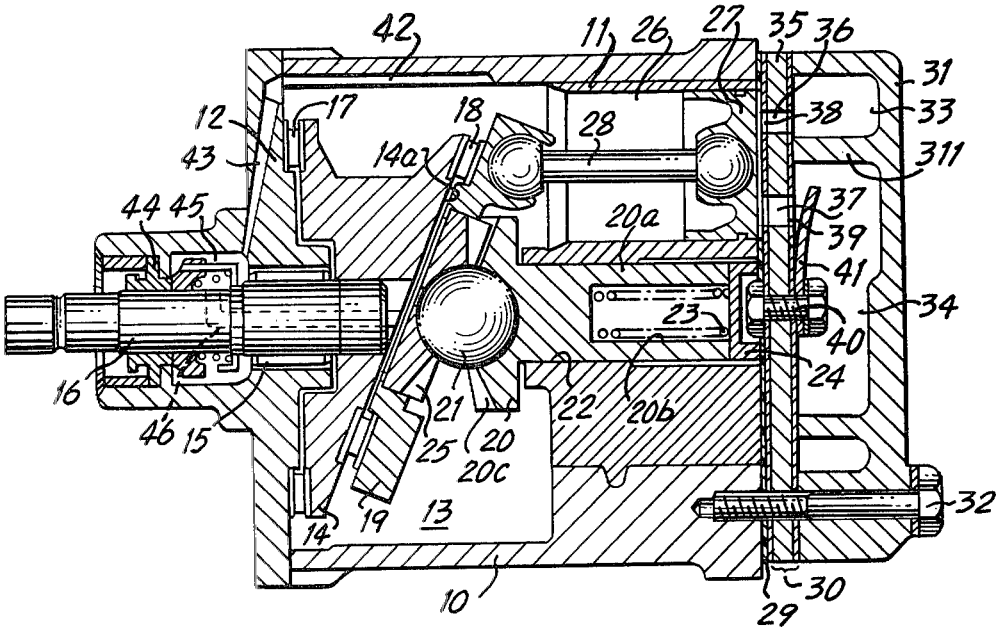
FIG. 1 is a sectional view of a refrigerant compressor of an embodiment according to this invention.
Figure 2A:
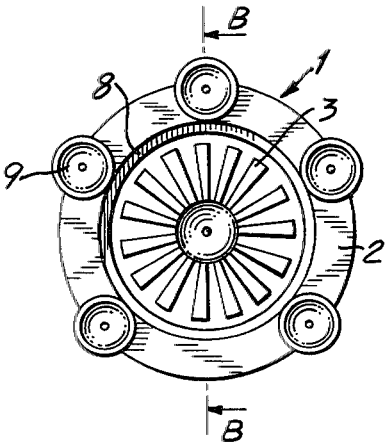
FIGS. 2*a*–2*c* are a rear view, a cross-sectional view taken along line B—B in FIG. 2*a* and a front view respectively, of a known wobble plate construction.
Figure 2B:
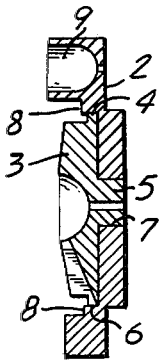
Figure 2C:
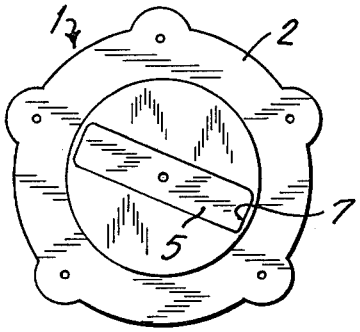

Referring to FIG. 1, there is shown an embodiment of the present invention comprising a substantially cylindrical housing 10, a cylinder block 11 which is closely fitted into and secured to the housing at an end thereof, and a front housing or cover plate 12 which is secured to the other end of housing 10. The interior of housing 10 defines a crank chamber 13 between cylinder block 11 and front housing 12. A cam rotor 14 which is disposed within crank chamber 13 is fixedly mounted on an inner end of a drive shaft 16. Drive shaft 16 extends through a central portion of front housing 12 and is rotatably supported by means of bearing such as a needle bearing 15 in front housing 12. Cam rotor 14 is also supported on the inner surface of a front housing 12 by means of a thrust needle bearing 17. In crank chamber 13, a wobble plate 19 is also disposed in close proximity with the inclined surface 14*a* of cam rotor 14 with a thrust needle bearing 18 therebetween. The wobble plate 19 is nutatably but non-rotatably supported on a ball bearing 21 seated at an end of a supporting member 20.

Supporting member 20 comprises a shank portion 20*a* having an axial hole 20*b* at the other end thereof and a bevel gear portion 20*c* at the end of the shank portion 20*a* which has a seat for ball bearing 21 at the center thereof. The supporting member is axially slidably but non-rotatably supported within cylinder block 11 by inserting the shank portion into a central axial hole 22 formed in cylinder block 11. The rotation of supporting member 20 is prevented by means of key and key groove (not shown). A coil spring 23 is disposed in axial hole 20*b* of the supporting member, the outer end of spring 23 is in contact with a screw member 24 screwed into central hole 22 of cylinder block 11, so that supporting member 20 is urged toward wobble plate 19. Bevel gear portion 20*c* of the supporting member 20 engages with a bevel gear 25 mounted on wobble plate 19 so that the rotation of the wobble plate is prevented. Ball bearing 21 is seated in the seat formed at the central portion of bevel gear portion 20*c* and also seated in a seat formed the central portion of bevel gear 25, so that wobble plate 19 may be nutatably but non-rotatably supported on ball bearing 21.

Cylinder block 11 is provided with a plurality of axial cylinders 26 formed therein, within which pistons 27 are slidably and closely fitted. Each piston 27 is connected with wobble plate 19 by a piston rod 28. The connections between the piston rod and piston and the connection between the piston rod and wobble plate are made by ball joint mechanisms.

On the outer end of cylinder block 11, a cylinder head 31 is disposed and is secured thereto by means of bolts 32, on interposed gasket member 29 and a valve plate assembly 30 therebetween.

Cylinder head 31 is provided with a suction chamber 33 and a discharge chamber 34 separated by a partition wall 311. Valve plate assembly 30 comprises a valve plate 35 having suction ports 36 connecting suction chamber 33 and respective cylinders 26, and discharge ports 37 connecting discharge chamber 34 and respective cylinders 26, a suction reed valve member 38, a discharge reed valve member 39, a stopper plate 41 for suppressing excessive deformation of discharge reed valve member 39, and bolt and nut means 40 for securing the suction and discharge reed valve members and the stopper member to the valve plate.

In operation of the compressor, drive shaft 16 is driven by any suitable driving means such as automobile engine. Cam rotor 14 rotates with the drive shaft, so that wobble plate 19 may nutate about ball bearing 21 according to the rotation of inclined surface 14*a* of cam rotor 14. The nutation of wobble plate 19 causes reciprocating movement of respective pistons 27 within cylinders 26. Therefore, the evacuation and compression of the refrigerant gas is repeatedly performed in each cylinder. The refrigerant gas circulates through a cooling circuit which is connected between an inlet port (not shown) and an outlet port (not shown) which are provided on cylinder head 31 to be connected with suction chamber 33 and discharge chamber 34, respectively.

The shown compressor shown is provided with lubrication system.

During operation of the compressor, part of the refrigerant gas in each cylinder passes into the crank chamber 13 as blow-by gas through a gap between an inner wall of cylinder 26 and piston 27. In order to return the blow-by gas to suction chamber 32, a passageway (not shown) which is a so called balance hole is formed in cylinder block 11 and through valve plate assembly 30 to communicate between crank chamber 13 and suction chamber 32. In crank chamber 13, lubricating oil is held which is agitated and splashed during operation of the compressor and it lubricates the internal moving parts in the form of an oil mist. Part of the oil mist in the crank chamber flows to suction chamber 32 together with the returning refrigerant gas through the balance hole and the mist is sucked into respective cylinders to lubricate the gap between pistons 27 and the inner walls of cylinders 26.

On the other hand, housing 10 is provided with an oil deflector 42 formed on the inner surface thereof for directing the oil flow along the inner wall of housing 10 toward front housing 12, as disclosed in U.S. Pat. No. 4,005,948 to Hiraga. Housing 12 is provided with an oil passageway 43 which communicates between crank chamber 13 at the front end of deflector 42 and a shaft seal cavity 45 formed in the front housing 12, to direct the oil flow to shaft seal cavity 45. In the shaft seal cavity, a shaft seal assembly 44 is disposed about drive shaft 16 extending therethrough. Drive shaft 16 is provided with an oil passageway 46 which communicates between shaft seal cavity 45 and crank chamber 13. Accordingly, oil flowing along the inner surface of housing 10 is directed to oil passageway 43 by deflector 42, and flows into shaft seal cavity 45. Part of the oil returns therefrom to crank chamber 13 lubricating needle bearing 15 supporting the drive shaft and thrust needle bearing 17, while another part flows through oil passageway 46 into the crank chamber 13 lubricating the needle bearing 18.

Figure 3A:
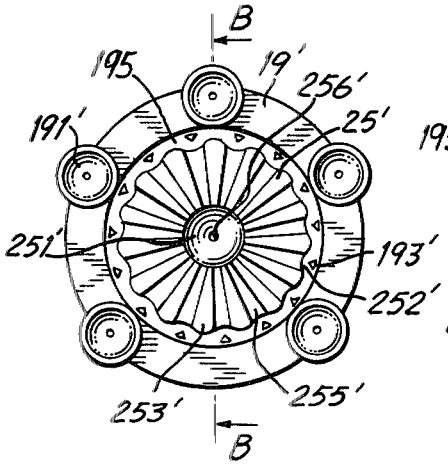
FIGS. 3*a*–3*c* are a rear view, a cross-sectional view taken along line B—B in FIG. 3*a* and a front view, of the wobble plate in the embodiment shown in FIG. 1.
Figure 3B:
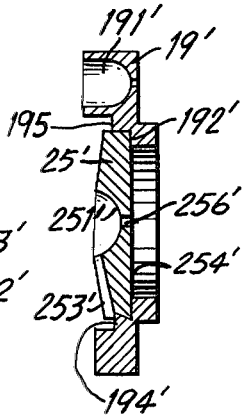
Figure 3C:
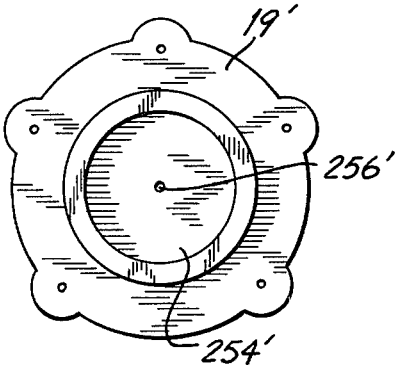
Figure 4:
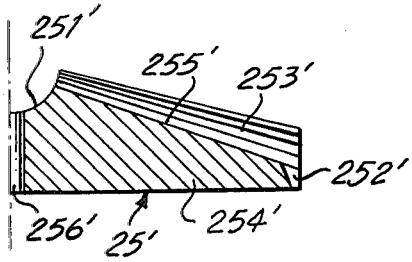
FIG. 4 is an enlarged partial sectional view of the bevel gear member in FIGS. 3*a*–3*c*.

Referring to FIGS. 3*a*–3*c*, wobble plate 19 having bevel gear 25 comprises a ring member 19' of, for example, aluminum alloy and a bevel gear member 25' of, for example, chromium molybdenum steels. The ring member is provided with a plurality of equiangularly spaced ball sockets 191' for receiving end balls of piston rods 28 (FIG. 1), and with a counterbore 192' on the same side as the ball sockets. Bevel gear member 25' is provided with a concave spherical surface forming a ball seat 251' at the center of the gear and a plurality of axial grooves 252' in the peripheral side surface of the gear. Each groove is formed to be connected with valleys 255' between adjacent teeth 253', as shown in FIG. 4. The back side of the bevel gear member is formed in a plane surface 254'. A hole 256' is an oil hole for feeding the lubricating oil to ball seat 251'.

Bevel gear member 25' is fitted into counterbore 192' with teeth 253' being in the same direction as ball sockets 191'. The peripheral edge 193 of counterbore 192' is caulked at a plurality of positions as shown by 193' corresponding to axial grooves 252' of the bevel gear member so that the material of the ring member 19' may be moved into grooves 252' and between teeth as shown by 194'. Thus, bevel gear member 25' is secured to ring member 19' and relative axial movement and relative rotation of the bevel gear member and the ring member are prevented by the moved material due to the caulking operation at the same time.

If the moved material injuriously affects the engagement of bevel gear member 25' with bevel gear 20 (FIG. 1), the bottom surface of each groove 252' may be formed with an incline so that the depth of the groove is deepest at the end connecting with valley's 255', as shown in FIG. 4. The moved material is kept within the grooves but does not extend on the bottom surface of valley 255'. Thus, bevel gear member 25' is secured to ring member 19' without affecting the engagement between both bevel gears. The bottom surface of the groove may alternately be formed in a stepped configuration instead of inclined.

In accordance with to the construction of the improved wobble plate, its weight is decreased in comparison with the known wobble plate in which the boss of the bevel gear is fitted into the hole of the plate member.

Furthermore, because the bevel gear member is formed as a simple construction without any boss and because the ring member is also simply and accurately formed, the wobble plate is simply and precisely made with the central axis with the center of the ball bearing received in the ball seat.

Because the relative rotation of the bevel gear member and the ring member is prevented at the peripheral portion of the bevel gear member, a relatively greater degree of strength to prevent relative rotation is obtained.

The number of the axial grooves formed in the peripheral surface of the bevel gear member is not restricted to a particular number. The greater the number, the greater the strength. Each axial groove may be formed to extend over the axial length of the peripheral surface of the bevel gear, or may fall short of the back peripheral edge.

What is claimed is:

1. In a refrigerant compressor unit comprising a cylinder block having a plurality of equiangularly spaced cylinders, a plurality of pistons slidably and closely fitted into respective ones of said cylinders, a drive shaft, a cam rotor mounted on an end of said drive shaft having an inclined end surface, a wobble plate disposed in proximity with said inclined end surface and having a centered first bevel gear which is provided with a centered ball seat, a second bevel gear supported on said cylinder block and having a centered ball seat, a ball bearing seated in both of said ball seats and supporting said wobble plate so as to be able to nutate about the center of said ball, piston rods connecting respective said pistons to said wobble plate, the improvement comprising said wobble plate including a ring member having a counterbore and said first bevel gear member, said first bevel gear member being fitted into said counterbore and secured to said ring member by mechanically deforming the peripheral edge of the counterbore to prevent relative rotation and axial movement of said ring member with respect to said bevel gear member.

2. The improvement as claimed in claim 1, wherein said first bevel gear member is provided with a plurality of axial grooves in the peripheral side surface thereof, said grooves being connected with adjacent valleys between adjacent teeth of said gear, and the material of said ring member being displaced into said axial grooves and displaced between said teeth by said mechanical deforming.

* * * * *